United States Patent [19]

Joelson

[11] 4,123,033

[45] Oct. 31, 1978

[54] APPARATUS FOR FORMING HOLLOW CYLINDRICAL PIPES OF REINFORCED CONCRETE

[76] Inventor: Carl R. Joelson, P.O. Box 296, Venice, Fla. 33595

[21] Appl. No.: 831,967

[22] Filed: Sep. 9, 1977

[51] Int. Cl.[2] ..... B28B 7/18

[52] U.S. Cl. ..... 249/65; 249/100; 249/144

[58] Field of Search ..... 425/405, 432, 438; 249/100, 144, 65

[56] References Cited

U.S. PATENT DOCUMENTS

| | | | |
|---|---|---|---|
| 2,865,078 | 12/1958 | Hasselblad | 425/405 |
| 3,171,169 | 3/1965 | Graef | 425/405 |
| 3,584,356 | 6/1971 | Joelson | 425/432 |
| 3,651,180 | 3/1972 | Glueckert | 264/51 |
| 3,764,641 | 10/1973 | Ash | 264/45 |
| 3,833,694 | 9/1974 | Hughes | 264/51 |
| 3,891,736 | 6/1975 | Voaden | 264/92 |

*Primary Examiner*—Francis S. Husar
*Assistant Examiner*—John McQuade

[57] ABSTRACT

Improved apparatus for forming hollow cylindrical pipes of reinforced concrete wherein the pipe is formed in a vertical position and the principle components for forming the pipe comprise a bottom pallet and saddle, an outer jacket, a core positioned concentrically in spaced relationship within the outer jacket and a reinforcing cage positioned between the center core and the jacket and sealing means are provided for sealing the relationship between the bottom pallet, the outer jacket and the inner core. Use is made of movable elastic seals on the lower ends of the outer jacket and the core. The seals can be expanded inwardly toward the pallet by means of a positive pressure until the concrete has been poured into the form and compacted by vibration. Negative pressure is then utilized to withdraw the elastic seals from the formed pipe and the inner core and outer jacket are subsequently removed from the green pipe.

8 Claims, 9 Drawing Figures

APPARATUS FOR FORMING HOLLOW CYLINDRICAL PIPES OF REINFORCED CONCRETE

BACKGROUND OF THE INVENTION AND THE PRIOR ART

In the formation of reinforced concrete pipes in a vertical position, in order to obtain the required density of the mix within the form to provide the necessary strength to the pipe and to eliminate voids, it was found in the prior art that it was desirable to use a vibration form of compacting or settling the mix as it was put into the form.

"No slump" concrete is always used in the formation of reinforced concrete pipe in which the jacket, or, core and jacket are removed immediately after the pipe has been formed. The no slump concrete is placed in the form and then packed and densified by various methods.

One method is to vibrate the "no slump"concrete which turns it into a fluid mix causing the mix to settle and density. When the vibration ceases, the fluid mix reverts back to a firm, dense, stable mix so that the jacket and core forms can be removed immediately without causing the newly made pipe to collapse.

All vibrating type molds cause the finer particles of the fluid mix, i.e., a mixture of water, cement and fine sand, hereinafter referred to as "slurry" to seek any crevice or open space in the forms from whence it could leak out. Previous vibrating machines, such as those described in U.S. Pat. No. 3,119,165 and 3,273,216, had a leakage at the junction of the jacket and bottom pallet and/or at the junction of the bottom pallet and the core or even in both places. In those machines known in the prior art, which were composed of two and three-piece jackets and/or cores, there was an additional leakage at the horizontal joints of such jackets or vertical joints in those instance of jackets which were hinged.

The loss of slurry from any mold is serious not only because of the weakening of the pipe and the change in the appearance of the pipe, but also because a grinding compound is really formed from the slurry, and when it falls or splatters on the moving parts of the apparatus, it causes unnecessary wear and maintenance, is wasteful and creates an unnecessary cleanup problem.

In those machines such as described in U.S. Pat. Nos. 2,966,716, 3,047,929 and 3,334,390, which used various types of rubber or elastic seals, the slurry provided a coating on the core and jacket that had an abrasive action which formed almost a grinding compound. The movement of the jacket and core caused wear on the seals, and it was necessary to continually readjust the seals or to replace them as the grinding became severe.

In other types of known machines, the problem of slurry was recognized, and the seals could be made more liquid-tight with respect to the core and jacket. However, when the sealing relationship was such as to make the mold liquid-tight, then the vibration was either greatly dampened as a result of the deadening effect of the seals, or an unusual amount of vibration was required in order to offset the damping effect.

The problems as set forth above were overcome in Applicant's U.S. Pat. No. 3,584,356 which is incorporated in its entirety herein by reference thereto.

As much improvement as Applicant'U.S. Pat. No. 3,584,356 contributed to the art, the apparatus and method was not always completely satisfactory. Under ordinary and practical working conditions, it is necessary that there be extremely close tolerances in the vertical positioning of the outer jacket and the inner core in relation to the fixed position of the bottom pallet. There was also a requirement for close tolerances in the horizontal relationship between the horizontal flanges of the bottom pallet and the outer jacket and the core. If these tolerances were exceeded it could result in one of more of the following problems: (a) leakage of the cement slurry; (b) variations in the wall thickness of the pipe at the groove or female end thereof; (c) a grinding action could develop between the inner edge of the bottom pallet and the bottom walls of the core which caused extreme wear on the core; (d) an excessive pressure was sometimes imposed upon the seals which dampened vibration. These tolerances were on the order of 1/16th inch plus or minus from the norm in both the vertical and horizontal positions.

These seals as set forth in the Applicant's prior patent, while superior to what was previously known in the art, occasionally resulted, and too often from a commercial standpoint, in the making of a small ridges or vertical flanges on the female ends of the pipe at both the interior and exterior wall surfaces. This, of course, wasted a small amount of material but, perhaps more importantly required additional labor and time in order to remove them. If these ridges were not removed, the outer ridge would concentrate pressure on the outer edge of the groove as the pipe were stacked in horizontal layers in the storage yard or being hauled to the job site, causing a portion of the groove to break off.

These ridges were fundamentally the result of the form of the elastic sealing means used in the Applicant's prior patent. The outer jacket carried a annular elastic ring in the lower end of the outer jacket. This elastic ring was generally of rectangular cross-section, and the lower surface of the ring was in contact with the upper surface of the lower, outwardly extending flange of the bottom pallet. If the outer jacket were not set down completely on the lower flange of the bottom pallet, a space could be formed between the lower edge of the outer jacket adjacent the elastic seal and the upper surface of the lower flange of the bottom pallet flange. The sealing means between the bottom pallet and the inner core was generally an additional annular ring of elastic material which generally had a circular cross-section. This ring was carried at the top of a saddle which supported and guided the positioning of the bottom pallet which had an interior opening to accommodate the insertion of the inner core. The elastic seal made contact with the under surface of the upper, inwardly extending flange of the bottom pallet and with the outer wall surface of the inner core when the latter was positioned within the bottom pallet. Practical necessity required that there be a minimum tolerance of approximately 1/16th of an inch between the edge of the opening in the inner pallet and the outer wall of the inner core when it was inserted within the pallet opening.

In order to overcome the difficulties imposed by the elastic seals of Applicant's prior patent, which did prevent the leakage of the slurry, there was developed the use of expansible elastic seals between the bottom wall of the outer jacket and the outwardly extending, lower flange of the bottom pallet and between the outer wall of the inner core and the edge of the interiorly extending upper flange of the bottom pallet.

The Applicant is aware of the following prior art relating to the use of resilient membranes which are caused to function by the use of pressurized fluid in the formation of concrete pipes: U.S. Pat. Nos. 3,323,188; 3,107,158; 2,937,429; 2,052,818 and 3,548,466. In all these prior patents, the flexible membrane extends the full length of the form and its use appears to be principally that of compacting the material within the forms in order to increase the density of the pipe forming material. It is noted that in general the flexible membrane is employed against only the inner wall of the pipe being formed.

The present improvement in the sealing of the lower ends of the outer jacket and the inner core and the bottom pallet provides a more practical and working tolerance of up to ½ inch, plus or minus from the norm, both in the vertical positioning of the jacket and core with respect to the bottom pallet as well as the horizontal relationship between the jacket and the core and the respective outer and inner flanges of the bottom pallet. Further as the improved sealing means are subjected to pressure and move toward the respective flanges of the bottom pallet, they position the bottom pallet concentrically relative to the jacket and the inner core so that a uniform thickness of pipe is maintained, particularly with reference to the female end which is formed at this point in the apparatus. The application of positive pressure to the improved seals causes them to grip the vertical edges of the lower and upper flanges of the bottom pallet to form a liquid-tight mold which to all intents and purposes is unitary at this portion of the mold, thus causing the outer jacket pallet and inner core to vibrate in unison with no appreciable damping effect. As a result, there is no longer any abrasive action as a result of relative movement between the flanges of the bottom pallet and the outer jacket and inner core. The location of the improved seals as well as their form eliminates any downward pressure on the flanges of the bottom pallet. The use of the improved seals forms a slight taper on both the outer and inner surface of the female end of the pipe and eliminates the possibility of the production of the undesirable ridges or flanges which have been discussed above. The use of the improved sealing means also results in a smaller bottom pallet with respect to the upper and lower flanges and enables the bottom pallet to be lighter in weight and less expensive to manufacture and easier to be positioned by hand. Additionally, after the pipe has been formed, the positive pressure is released from the seals whose elastic nature causes them to tend to return to a position where they are then free of contact with the edges of the lower and upper flanges of the bottom pallet. However, the additional application of negative pressure at the prescribed times makes the stripping of the inner core and outer jacket from the green pipe easier as well as facilitating other related operations, and thus substantially no danger of any damage to the male end of the newly formed green pipe exists.

SUMMARY OF THE PRESENT INVENTION

The present invention comprises a jacket mold for forming a reinforced concrete pipe in a vertical position in which the jacket mold has a depending flexing sealing assembly secured to the lower edge of the jacket, and a male core member for insertion concentrically within the outer jacket which core has an flexing sealing assembly attached to the lower end thereof, the core being inserted within the female jacket in spaced relationship thereto. The invention also further comprises a bottom pallet having an central opening therein to receive the core, the opening being formed by an inwardly extending, upper annular ring, the bottom further having an outwardly extending lower annular ring, the total width of the outwardly extending annular ring and inwardly extending annular ring being less than the distance between the jacket and the core. Means are also provided for supplying positive and negative pressures to the expansible sealing skirt assembly on the jacket and also on the core.

BRIEF DESCRIPTION OF THE DRAWINGS

The present invention can be seen in the accompanying drawings wherein there are displayed the preferred embodiments of the invention. However, it is to be understood that the embodiments shown in the drawings are illustratively only as to the invention and that modifications may be made in the structure of the present invention and the application thereof and types and methods of bonding or securing the elastic band by those of skill in the art without departing from the scope of the invention as described in the specification and set forth in the appended claims.

DETAILED DESCRIPTION AND OPERATION OF THE INVENTION

DESCRIPTION OF THE DRAWINGS

Figure 1:
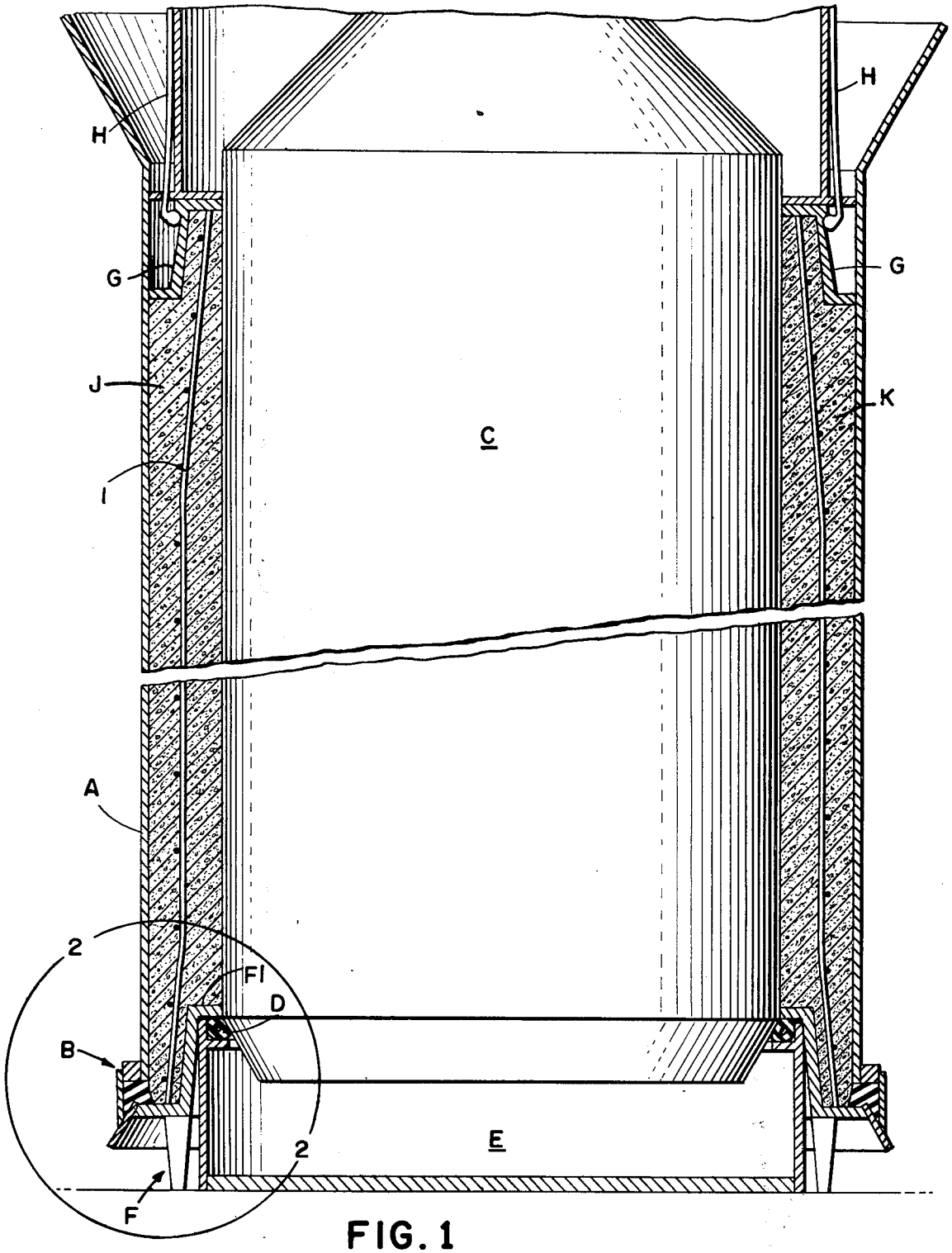
FIG. 1 PRIOR ART
FIG. 1 is a partial section of the jacket, core, bottom pallet and a pipe made with the foregoing elements in the cooperative relationship as shown in the Applicant's U.S. Pat. No. 3,584,356.

Referring to FIG. 1, A is the jacket which forms the outer or female portion of the mold. The jacket at its lower extremity carries the jacket sealing assembly B. C is the male core which is inserted concentrically within the jacket A in spaced relationship therewith. The saddle E provides centering for the bottom pallet F and also a support on the upper interior wall surface of saddle E for the sealing assembly D which engages the upper flange F1 on the bottom pallel F. G designates the top pallet which is pressed down upon the concrete mass forming the pipe J. The top pallet G is carried by the header assembly H. Between the jacket A and the core C there is inserted a wire reinforcing cage assembly I. Concrete K is poured into the space between the core C and the jacket A and vibrated into place by vibrating mechanisms on both the core C and jacket A (not shown). Specific details regarding the structure shown in FIG. 1 will be found in Applicant's prior U.S. Pat. No. 3,584,356.

Figure 2:
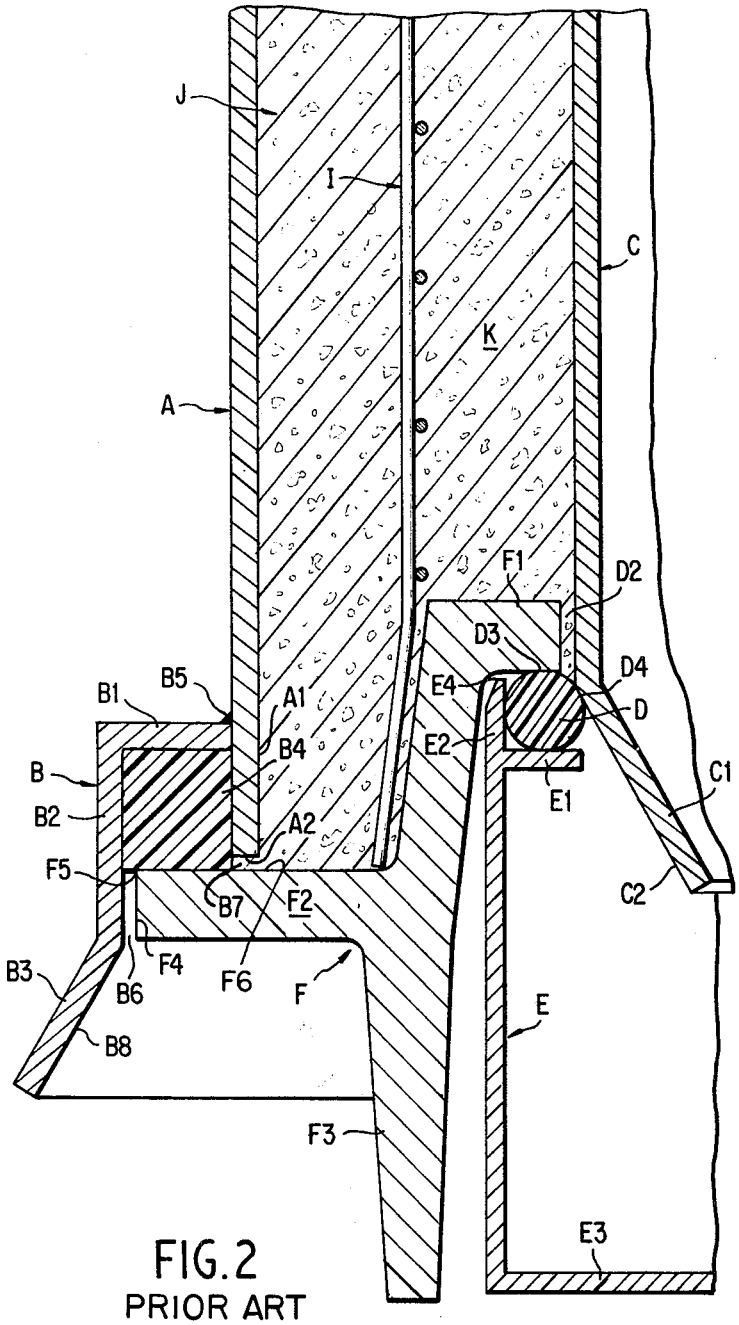
FIG. 2 PRIOR ART
FIG. 2 is a partial cross-section of the device shown in FIG. 1 within the circle 2—2 showing the relationship of the seals in the prior art to the bottom pallet, jacket and core.

FIG. 2 is a presentation at an enlarged scale of that portion of the device shown in FIG. 1 encompassed with the circle 2—2. Jacket A is a cylindrical shell of a steel of sufficient tensile strength, depending for its thickness and strength characteristics to some extent upon the size of pipe being molded. The jacket A terminates in a lower end portion A1. The jacket sealing assembly comprises a depending skirt assembly B having a substantially inverted L-shaped cross-section. The base of the skirt assembly B is a horizontal flange B1 extending outwardly from the lower portion A1 of jacket A. Flange B1 is normally secured to the outer wall of the jacket by welds B5. Depending from the outer end of flange B1 is a leg B2 which extends downwardly a sufficient distance to ensure that it is at least to the lower surface of the lower horizontal flange F2 on the bottom pallet assembly F. The width of the flange B1 is such that when the jacket is in place as shown in FIG. 2, there is a clearance of approximately 1/16th to ⅛th inch clearance or approximately 1/16th to ⅛th inch between the inner surface of depending leg B2 and the outer face F4 of the lower flange F2 on the bottom pallet assembly F. Extending outwardly at an obtuse angle on the lower end of depending leg B2 is a centering skirt B3. The function of the skirt B3 is to insure that, as the jacket A is lowered over the bottom flange assembly F, the bottom pallet assembly F is correctly positioned within the jacket assembly A. For example, if the bottom pallet assembly F is not correctly positioned under the jacket as it is being lowered, the surface B8 on the underside of the centering skirt B3 will strike the upper corner F5 of the lower flange F2 and will cam the bottom pallet assembly F inwardly so as to provide at least the normal clearance B6 shown between the inner surface of the depending leg B2 and the outer face F4 of the lower flange F2. Positioned within the recess formed by the lower portion A1 of jacket A, the flange B1 and leg B2 of the sealing assembly B, is an annular seal B4 of elastic material. While the cross-section of the seal B4 is preferably rectilinear, it will be apparent to those of skill in the art that the seal could be of a circular cross-section or of a rectilinear cross-section having rounded corners. The seal B4 may be adhesively secured within the recess, although generally speaking, the inherent elasticity of the seal B4 will cause it to constrict itself within the recess, particularly about the lower portion A1 of jacket A and more particularly if the seal has an interior diameter, at rest, slightly less than the exterior diameter on the jacket assembly A. It will be noted that the seal B4, when in contact with the upper face F6 of the lower flange F2, prevents lower surface A2 of the jacket assembly from making contact with the surface F6. The purpose in this is to prevent damage to the face A2 or to the surface F6 if the two were brought into contact, and particularly, in the course of the vibrating of the mold, to prevent grinding of either or both of these surfaces thus resulting in deformation of the female end of the pipe and excessive wear on F6 and A2 at area of contact, FIG. 2.

The core C is generally a hollow cylindrical body and as seen in FIG. 2 has a truncated cone bottom portion C1. The purpose of the truncated cone portion of the core is to provide a means whereby if the bottom pallet assembly F should not be properly centered within the jacket A, the surface C2 of the truncated cone portion C1 will strike the edge of the upper flange F1 of the bottom pallet assembly F and cause it to move toward the jacket assembly A so that the core C may be properly inserted within the central opening of the bottom pallet assembly F. The saddle assembly E is generally a hollow cylindrical body having a bottom plate E3 and upstanding vertical wall E2. On the inner side of the saddle E, adjacent its upper end E4, there is secured to the inner surface an annular inwardly extending flange E1. The flange E1 serves as a support in conjunction with the upper portion of the upstanding member E2 to provide a seat for the core sealing ring D. The core sealing ring D is generally of circular cross-section and while it may be adhesively secured to the upper surface of the flange E1 and the inner surface of the upstanding member E2, it may also be retained in this seat by virtue of the tendency of the elastic material, which comprises the seal D, to expand, particularly since the outer diameter of the seal D should preferably be just slightly larger than the inner diameter of the saddle E. In operation, the seal D makes contact with the under surface of the flange F1 of the bottom pallet assembly F at D3, and with the surface of the truncated portion C1 of the core assembly C at D4. The contacts that D3 and D4 make, normally flattens the seal surfaces slightly due to the compressive force exerted on the seal D by the weight of the core assembly C. It will be noted that the core assembly C and the vertical surface of the upper flange F1 form a tolerance space D2 which is approximately 1/16th to ⅛th of an inch under normal conditions.

Figure 3:
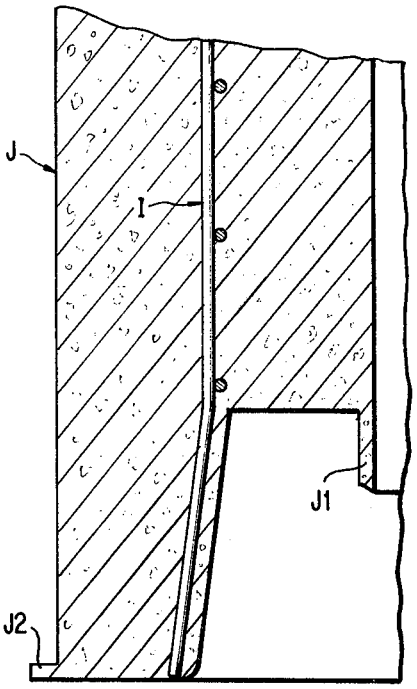
FIG. 3 PRIOR ART
FIG. 3 is a partial section of the pipe formed in accordance with the device shown in FIGS. 1 and 2.

In FIG. 3 it will be readily seen that the formed pipe has two ridges J1 and J2 at the end where it was formed by the bottom pallet assembly F. The ridge J1 is formed by the tolerance space D2 between the bottom pallet assembly and the core assembly, and the ridge J2 is formed by the tolerance space B7 between the bottom of the jacket assembly A2 and the upper surface F6 of the horizontal lower flange F2 of the bottom pallet assembly F.

Figure 4:
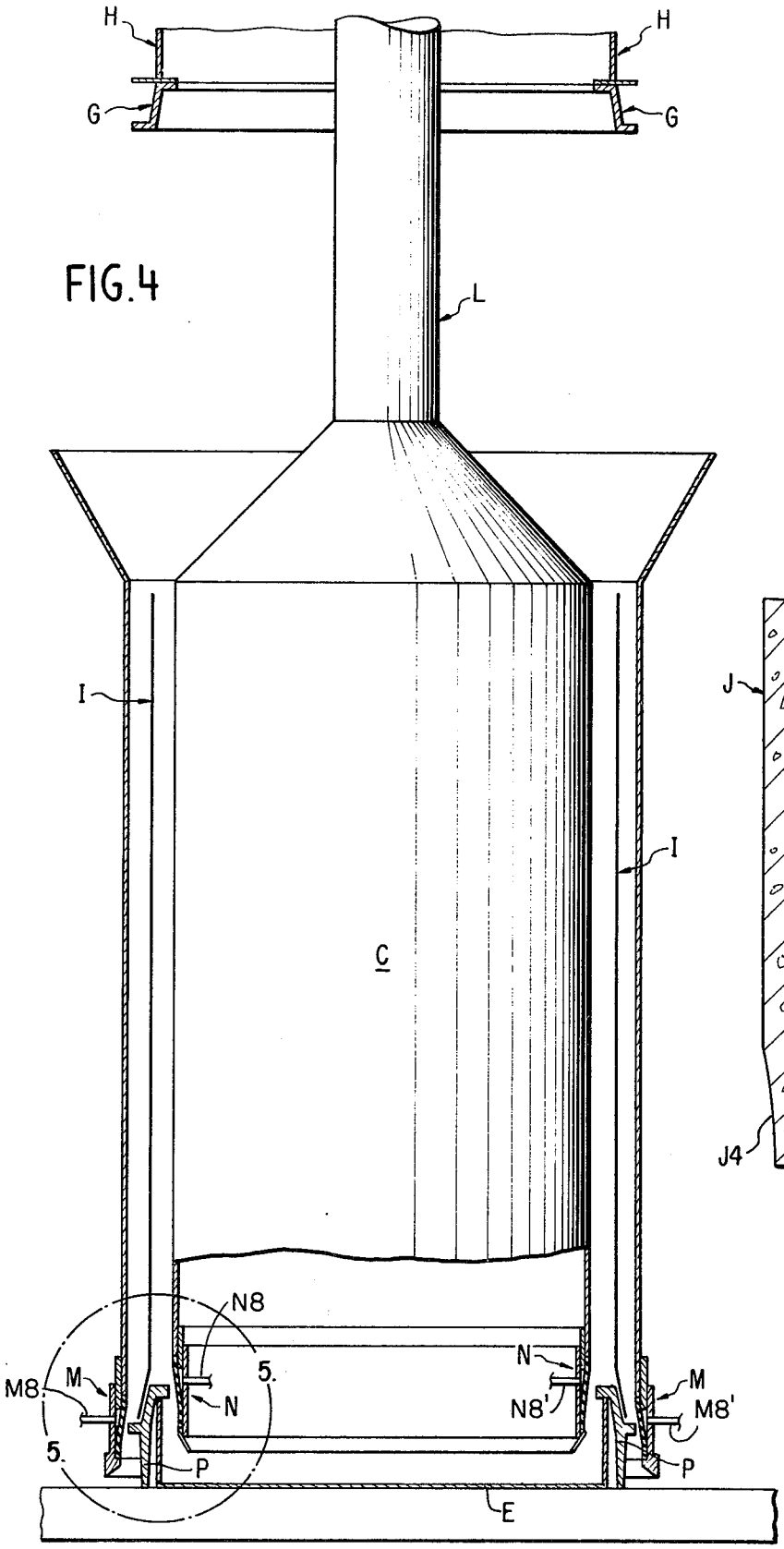
FIG. 4 is a schematic presentation of the device shown in FIG. 1 encompassing one embodiment of the improvements of the present invention.

Referring now to FIG. 4, since many of the components shown in that figure are substantially identical to like components shown in FIG. 1, the same reference numerals have been used for clarity and ease of expression. In this figure the top pallet G is shown in the raised position in contrast to the lower position shown in FIG. 1. The header assembly H is still attached to the top pallet G by the means and in the manner described by Applicant's prior U.S. Pat. No. 3,584,356. The core assembly C is shown attached to its core shaft L whose construction and operational functions are similarly described in the Applicant's prior patent.

This figure shows the improved jacket assembly flexing seal assembly M and the core flexing seal assembly N in stylized form in view of the small scale of the drawing. The drawing also shows the same bottom pallet assembly on saddle E and also an improved bottom pallet assembly P which is employed with the improvements of the present invention.

Figure 5:
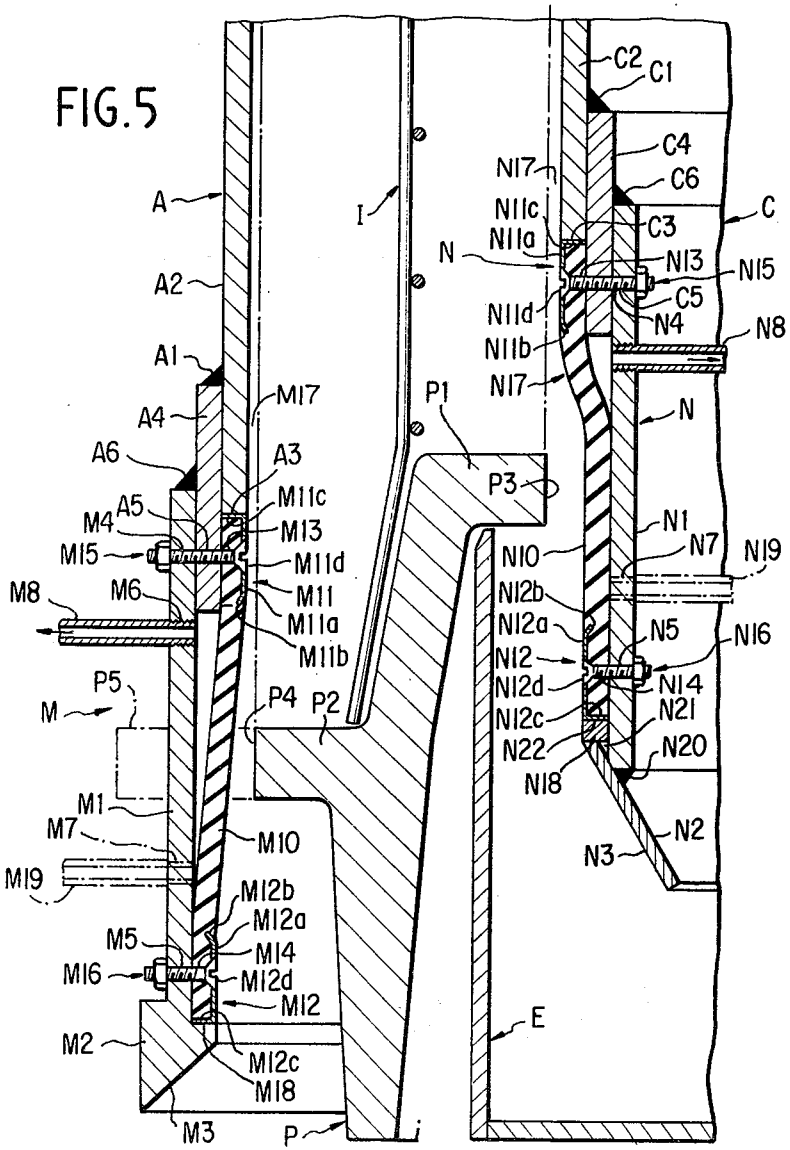
FIG. 5 is a partial section of the device shown in FIG. 4 and more particularly that portion thereof as encompassed by the circle 5—5.

With reference to FIG. 5, the details of the present invention will be seen more clearly and understood as the drawing is described. The jacket assembly A has an outer wall A2 similar in structure and strength as that previously described for the device shown in FIG. 2.

The wall of the jacket assembly terminates at an edge A3 which will be seen to be well-spaced above the lower flange P2 of the bottom pallet assembly P. This is in contrast to the lower edge of the jacket assembly A shown in FIG. 2 which was just above the lower flange in that figure. Attached to the outer surface of the wall A2 is a jacket sealing assembly mounting plate A4. Mounting plate A4 is a dependent cylindrical steel band continuously attached by a weld A1 around the lower portion of the wall A2. In this figure, the plate A4 is attached to the wall A2 by means of a weld A1. The mounting plate A4 not only serves for the purpose stated but also provides a spacing for the expansible sealing assembly M as will be explained subsequently.

The core assembly C is substantially the same as the core assembly C described in FIG. 2, having a cylindrical vertical wall C2 of sufficient strength and structure to withstand the pressures of molding. The core wall C2 terminates at its lower edge C3 which is above the inner flange P1 of the bottom pallet assembly P. Attached to the inner surface of core assembly wall C2 is a core sealing assembly mounting plate C4. This plate, similarly to mounting plate A4 on the jacket assembly A, is a continuous, dependent circular band fixedly secured to the inner surface of the wall C2 by means of a weld C1. As with the mounting plate A4, the mounting plate C4 similarly serves not only as a plate upon which the core expansible sealing assembly N is mounted but also acts as a spacer for the purpose which will be disclosed subsequently.

The jacket assembly flexing sealing assembly M comprises a depending metal band M1 of a cylindrical configuration having any of the well-known cross-sections, extending continuously around the jacket assembly A and more particularly around the mounting plate A4. The band M1 terminates at its lower portion in a generally trapezoidal cross-section M2 which has on its underside a camming surface M3. The camming surface M3 provides means whereby when the jacket assembly and its attached flexing sealing assembly is lowered over the bottom pallet assembly P, the pallet assembly P can be pushed into concentric relationship with the jacket assembly A by the contact between the camming surface M3 and the lower flange P2 in the bottom pallet assembly P. The seal plate M1 has an opening M4 in its upper portion and an opening M5 in its lower portion to receive bolt and nut assemblies M15 and M16 respectively in the attachment of the expansible sealing assembly M to the mounting plate A4. The seal mounting plate M1 additionally has a threaded opening M6 in its upper portion to receive threaded inlet conduit M8. While the figure shows that the conduit M8 is threadedly attached to the sealing plate M1, it will be recognized by those of skill in the art that the conduit M8 could be welded to the outer surface of the sealing plate M1.

The sealing assembly M further comprises the seal member M10 which is an elastic cylindrical band. To attach the seal member M10 to the seal plate M1 (and mounting plate A4), use is made of two cylindrical spring steel clips, one M12 at the bottom edge of the seal M10 and another M11 at the top of the seal M10. These spring clips M11 and M12 are continuous bands, or a plurality of short bands, of metal having a hard, spring-like characteristic. Each of these spring clips consists of a vertical wall M11*a* and M12*a*, a depressed tang M11*b* and M12*b* which, when the spring clips are assembled on the seal, are forced slightly into the outer surface of the seal M10 to provide a gripping of the seal and compression of it at these points against the mounting plate A4 in case of the clip M11, and against the seal plate M1 in the case of the clip M12. The clips also have inwardly directed flanges M11*c* and M12*c* which protect the seal M10 in its contact with the lower edge A3 of the jacket wall A2 and the trapezoidal termination M2 of the seal plate M1.

The seal M10 is attached to the jacket assembly A by inserting the seal M10 into its respective spring clips M11 and M12 and placing the seal then on the inner surface of the mounting plate A4 and against the inner surface of the seal plate M1. The seal M10 has in its upper portion an opening M13 which is aligned with the opening M4 in the seal plate M1. The spring clip M11 has an opening M11*d* to receive the head of the bolt and nut assembly M15. To attach the upper portion of the seal M10 to the mounting plate A4, the bolt from the assembly M15 is inserted in through the opening M11*d* in the spring clip M11, the opening M13 in the seal M10 and opening A5 in the mounting plate A4, the opening M4 in the seal plate M1 and then the nut and lock washer is attached thereto.

The lower end of the seal M10 is assembled to the seal plate M1 in manner similar to the upper end. The bolt of the assembly M16 is passed through the opening M12*d* in spring clip M12, the opening M14 in the seal and the opening M5 in the seal plate M1, and the nut and lock washer are then attached to the bolt of the assembly M16.

It is to be noted that the trapezoidal cross-sectional end of the seal plate M2 of the seal plate M1 has a seat M18 formed on its interior side to receive the lower end of elastic seal member M10 within its spring clip M12. It is to be noted that as seen in FIG. 4, that the conduit M8 is the sole source of air supply for the jacket expansible sealing assembly M. Such a single source of supply is generally satisfactory for forming pipes of relatively small diameter. When forming pipes of larger diameters, the employing of two inlet sources M8, M8′diametrically opposed, may be appropriate and in some instances if needed the employment of three sources equilaterally spaced around the circumference of the jacket A may be found. Also it is possible under some pipe forming operations to utilize only an additional source of air supply indicated in phantom lines in FIG. 5 at M19.

The core assembly flexing sealing assembly N is identical to the flexing sealing assembly M with one notable exception. The depending seal plate N1 terminates in a truncated conical segment N2 which provides an exterior camming surface N3. The truncated conical section N2 is secured to the lower portion of the seal plate N1 by means of welds N20 and N21. An annular element N18 is also secured to the outer surface of the lower portion of the seal plate N1 by the weld N21 and forms a seat N22. The remaining elements of the flexing core sealing assembly N are identical to those of the jacket sealing assembly M and bear the same reference numerals but prefixed by letter N in place of the letter M. To assemble the core sealing assembly N to the core assembly C, the seal member N10 is inserted into the upper spring clip N11 and the lower spring clip N12. The upper end N11*c* of the spring clip N11 is then inserted into the seat C3, and the lower end N12*c* of the spring clip with the seal member N10 is inserted into seat N22. The bolt from the assembly N15 is then inserted through opening N11*d* in the spring clip N11, through the opening N13 in seal member N10, through opening C5 in mounting plate C4, through opening N4 in seal plate N1 and then the nut and lock washer of the assembly N15 attached to the bolt. In a similar manner the bolt from the assembly N16 is inserted through the opening N12*d* in the spring clip N12, through opening N14 in seal member N10, through opening N5, in seal plate N1 and the nut and lock washer of assembly N16 is then attached to the bolt.

As described with reference to the jacket sealing assembly M, the air conduit N8 is the single source of supply for the expansible seal assembly N. Again, should the diameter of the pipe so warrant similar conduits could be diametrically positioned within the core N8, N8′ (FIG. 4) or use to be made of three inlets equilaterally spaced within the interior of the core. Also use could be made of an additional air conduit indicated as N19 as discussed with reference to the sealing assembly M.

The difference in the positions of the seal M10 and the seal N10 as seen in FIG. 5 should be noted and is for illustration only. The position of M10 indicates the form of the seal when neither positive nor negative pressures have been applied through the conduits M8 and M9. The position of the seal N10 shows the form taken when negative pressures have been applied to the conduits N8.

It should be further understood that while the form of the end members of respective depending seal plates M1 and N1 are different, they could be identical with no change in the functioning of the apparatus.

The source of the negative and positive air pressures utilized with both sealing assemblies is not shown. It will be apparent to those of skill in the art that any conventional air supply means which can deliver either negative or positive pressures can be employed. In the event of employment of multiple pairs of air conduits, M8 and M19, ad N8 and N19, separate sources of the air supply could be provided for each conduit or the conduits could be connected by an annular conduit (not shown) which has a single connection to the air source. In the case of the air supply for the core expansible seal assembly, similar arrangements could be made either from a unit installed inside the core or by means of flexible conduits leading from the fixed structure of the overall assembly.

The bottom pallet assembly P as seen in FIG. 5 differs from the bottom pallet assembly F in FIG. 2 only in that the lower flange P2 is of less length than the comparable flange F2. In practice, the flange P1 and the flange P2 would be substantially of the same size. It is to be noted that with the present invention, the pallet assembly P provides a requirement for less of a lower flange than with the former bottom pallet assembly F. This is indicated in dotted lines by P5 as to the amount of material which can be saved when using the new bottom pallet assembly P of the present invention.

It should be noted that when the present invention is employed, there are tolerances M17 and N17, between the vertical surfaces of the flanges on the flanges P1 and P2 of the bottom pallet assembly P and the interior wall of the jacket assembly A and the exterior wall of the core assembly C. These tolerances can be as much as one-half inch for each and thus facilitate alignment of the bottom pallet and the bottom pallet assembly P, the jacket assembly A and the core assembly C since as will be explained later the operation of the expansible seal assemblies M and N will center the bottom pallet assembly P.

Figure 6:
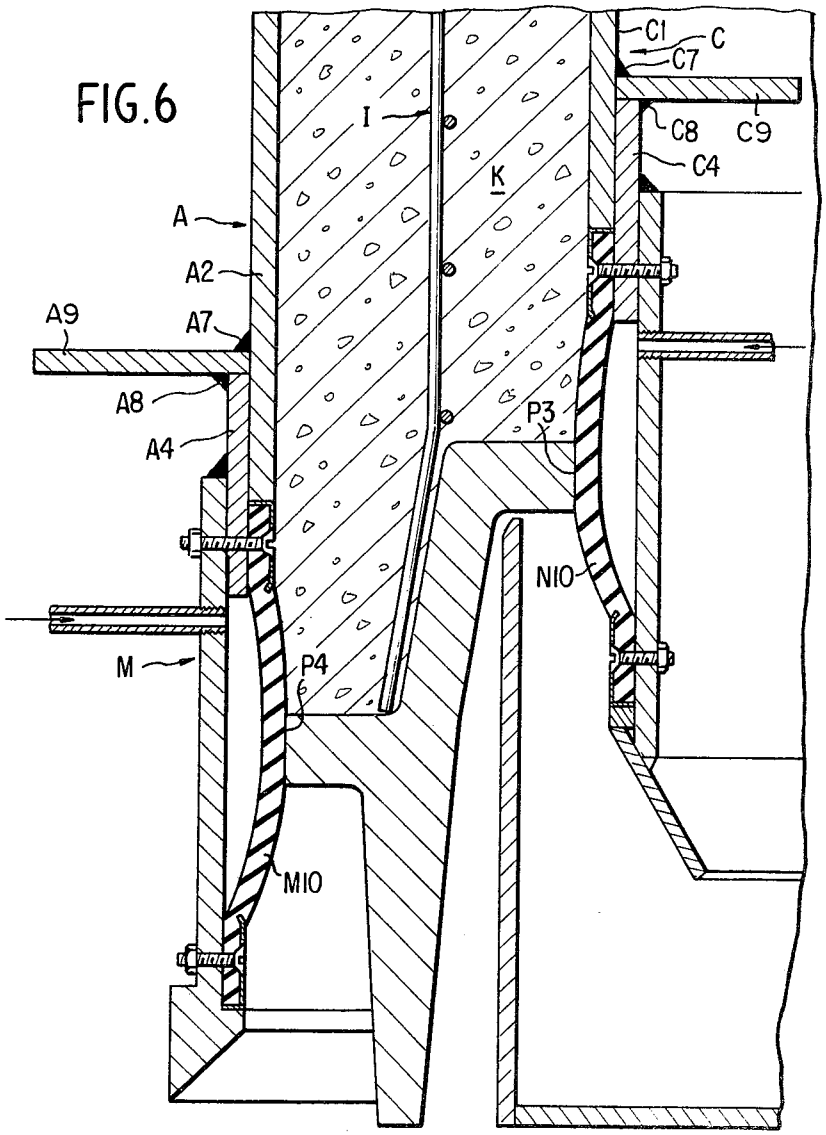
FIG. 6 is a partial cross-section of another embodiment of the device in FIG. 4 showing the position of the elements in the flexing seal assemblies of the present invention in their positon at the time of the formation of the pipe.

In FIG. 6, sealing assemblies M and N have been supplied with positive pressure of about 10 lbs. psi. This causes the seal M10 and N10 to be expanded into sealing contact with the respective vertical faces of the flanges of the bottom pallet assembly P. FIG. 6 also discloses additional components required in the production of pipes of uniform cross-section. In each instance an additional reinforcement has been provided to the respective jacket assembly and core assembly to maintain the outer wall in designed shape. With reference to the jacket assembly A, the reinforcement comprises an annular ring shaped flange A9 which is secured to the mounting plate A1 by weld A8 and secured to the outer surface of the jacket assembly wall A2 by the weld A7. Similarly the core assembly C is provided with an annular inwardly extending flange C9 which is secured to the mounting plate C4 by the weld C8 and secured to the inner surface of the core wall C1 by weld C7.

Figure 7:
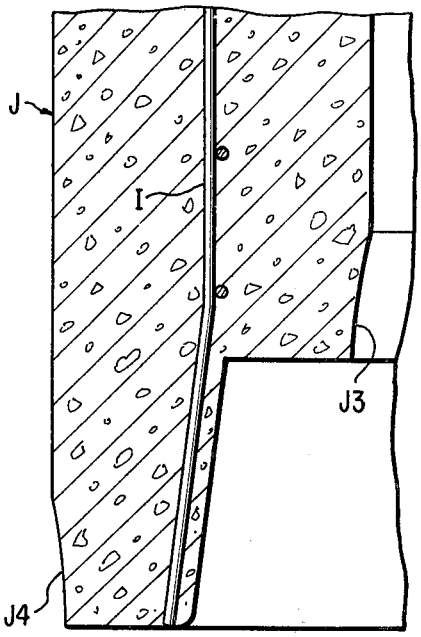
FIG. 7 is a partial section of that portion of the formed pipe seen in FIG. 6.

FIG. 7 shows the portion of the female end of the pipe formed with the new invention. It is to be noted that the surfaces of the pipe which were in contact with the sealing means of the present invention no longer exhibit the ridges shown in FIG. 3. Rather these portions of the pipe now comprise a slight concave surface which terminates in the flat ends of the pipe and thus requires no additional labor for removing any ridge nor presents any danger of damaging the ends of the pipe by the presence of ridges.

Figure 8:
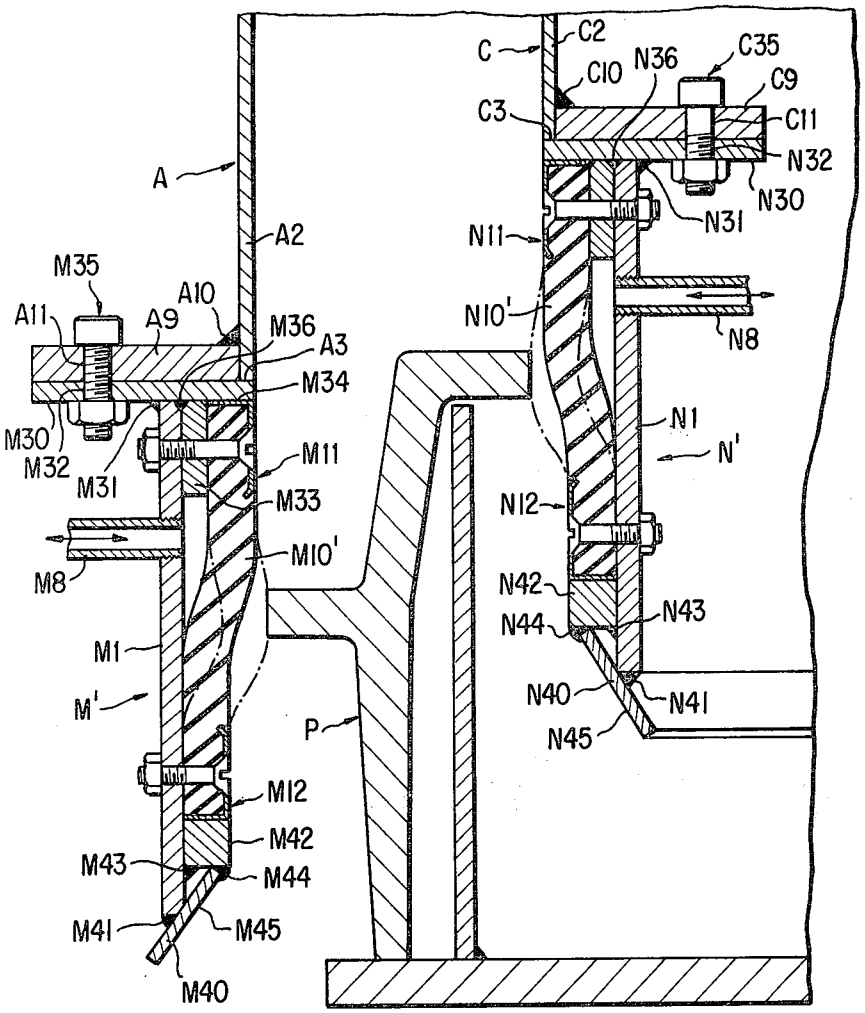
FIG. 8 is a partial section of the device seen in FIG. 4 showing yet another embodiment of certain aspects of the elastic seal assemblies which comprise the invention.

FIG. 8 shows an alternate embodiment for mounting sealing assemblies on the jacket assembly A and core assembly C respectively. Other than the mounting means and thicker sealing members M10′ and N10′, the sealing assemblies M′ and N′ shown in FIG. 8 are identical to those shown in FIGS. 5 and 6. Sealing members M10 and N10 are shown in position when a vacuum is applied to conduits M8 and N8. The dotted lines show members M10′ and N10′ under positive pressure. In this embodiment, the mounting plate on the jacket assembly A for the sealing assembly M′ comprises an outwardly extending annular flange A9 which is secured to the outer wall A2 of the jacket assembly A by means of weld A10. It will be noted that the flange A9 extends to the wall A2. Flange A9 contains an opening A11 for the insertion of a lock and bolt and nut assembly M35. The sealing assembly M′ is attached to the annular flange A9 by means of an annular flange M30, extending under wall A2 in contact with the end A3 of wall A2, is secured to the seal plate M1 by welds M31 and M36. The flange M30 contains an opening M32 to receive the securing bolt and nut assembly M35. To compensate for the absence of the mounting plate A4 as seen in FIG. 5, use is made instead of a spacer plate M33 which comprises a continuous metal band which is inserted between the seal member M10′ and the seal plate M10′. The inner under surface of the flange M30 provides a seat M34 to receive the spring clip M11 with the seal M10′ inserted therein. Note that in this embodiment seal plate M1 terminates in an outwardly extending conical band M40 which is welded M41 to the end of plate M1. The spring clip assembly M12 is seated on a bar M42 welded at M43 to plate M1 and with a filet weld M44 between the bar M42 and band M40. A surface M45 or band M40 provides the camming of the pallet assembly P if it is not properly centered.

The sealing assembly N′ is attached to the core assembly C in identical manner as the sealing assembly M'. For sake of brevity a description of the components is omitted but the identical reference numerals have been shown prefaced only by the change in the designation of the core assembly C and the sealing assembly N'. It will be noted that the flanges C9 and N30 are inwardly extending flanges rather than outwardly extending flanges as in the case of A9 and M30.

Figure 9:
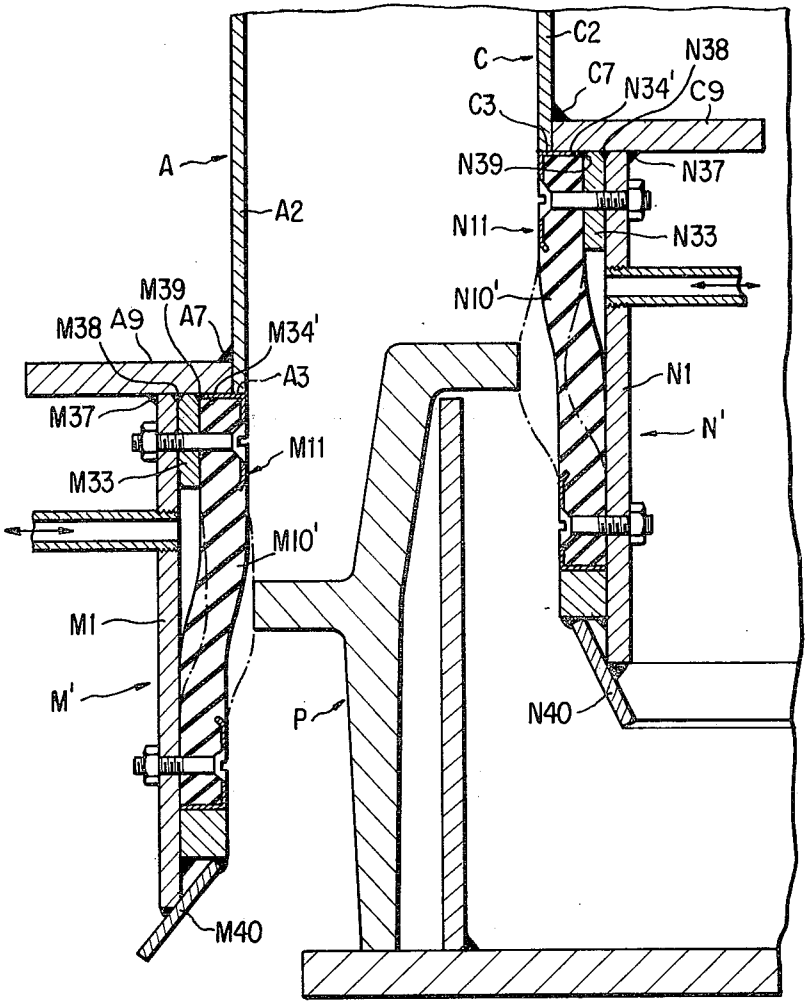
FIG. 9 is a partial cross-section of another embodiment of the device shown in FIG. 4.

FIG. 9 shows an embodiment combining reinforcing flanges A9, C9, of FIG. 6 with the sealing assemblies M' and N' of FIG. 8. The reinforcing flanges A9 and C9 are welded at A7 and C7 to the outer walls of the jacket A and core C. Flanges A9 and C9 do not extend under the walls A2 and C2 as do flanges M30 and N30 in FIG. 8. Thus seats M34' and N34' for assemblies M' and N' are formed from the end surfaces A3 and C3 of walls A2 and C2 and a portion of the under surface of flanges A9 and C9. Spacer plates M33 and N33 are joined to seal plates M1 and N1 by welds M38 and N38. These two suchly joined units are then secured to the undersides of flanges A9 and C9 by welds M31 and M30 and A13 and N39. Other than the foregoing the sealing assemblies M' and N' shown in FIG. 9 are substantially identical with similar assemblies shown in FIG. 8.

OPERATION

Formation of reinforced concrete pipes employing the present invention is in accordance with the following sequence.

The bottom pallet assembly P is placed by hand over the saddle E, generally as concentric as possible commensurate with consideration of time. The reinforcing cage I is centered on flange P2 of the pallet assembly P. The jacket assembly A is then lowered by means described in Applicant's U.S. Pat. No 3,584,356 toward the bottom pallet assembly P with sufficient negative pressure in the conduit M8 to draw the seal M10 back against the seal plate M1. As the jacket is lowered to its final position, the camming surface M3 may strike the edge of the lower flange P2 in the pallet assembly P if it has not been correctly positioned with reference to the jacket assembly A. If such occurs, the camming surface M3 will push the pallet assembly P away from that portion of the jacket with which it is in contact until the vertical surface P4 of the flange P2 will clear the interior of the jacket. At this time, with the seal M10 against the seal plate M1, there is no danger of tearing or abrading the seal M10.

The core assembly C is then lowered within the reinforcing cage I by the apparatus as described in prior U.S. Pat. No. 3,584,356. As with the jacket assembly lower, negative pressures are applied to the conduits N8 to draw the seal N10 against the seal plate N1. If any portion of the upper flange P1 of the bottom pallet assembly P is not properly centered within the jacket, the camming surface N3 of the truncated cones terminus of the sealing assembly N will contact the edge of the upper flange P1 and move it away from the core assembly.

With the jacket assembly A and the core assembly C now in position for molding, the air conduits M8, N8 are then supplied with positive pressure of approximately 10 lbs. psi to force the respective seal members M10 and N10 out into contact with the surfaces P3 and P4 of the respective flanges as shown in FIG. 6. This expansion forms a liquid-tight seal between the respective seals M10 and N10 and their associated vertical faces of their associated flanges P4 and P3. Then according to the procedure outlined in the Applicant's U.S. Pat. No. 3,584,356 the concrete mix is placed in the space between jacket assembly and the core assembly C and the mold is subjected to a vibration as set forth in that patent. When the mold has been filled in accordance with the procedures outlined in the above patent, the top pallet E is then lowered by the mechanism described in the above patent. When the formulation of the pipe has then been completed, the vibration is stopped, the air is exhausted from sealing assemblies M and N, and a negative pressure, up to 27 lbs. psi is then applied to completely withdraw the seal N10 of any contact with the newly formed pipe interior surface. The core is then lifted upwardly through the newly formed pipe.

The air is then exhausted from the sealing assembly M, and negative pressure of up to 27 lbs. psi is applied to withdraw the seal M10 from contact with the outer surface of the pipe to bring the seal into contact with the seal plate M1. The jacket is then lifted upwardly as outlined in the aforementioned patent, and since the seal member 10 has been drawn against the seal plate M1, the seal member M10 passes around the top pallet G without disturbing or lifting it off the pipe. As the jacket A is lifted above the newly formed pipe, the header element H releases the top pallet G and moves upwardly as described in the foregoing patent. The newly made pipe is ready to be removed from its position on the saddle and transported to the curing area with the bottom and top pallets in place.

While mechanical bonding of the seal members M10 and N10 has been described, it is to be understood that vulcanization or chemical bonding of these members to their respective, adjacent spacer plates are alternatives.

It will be understood that various changes in details, materials and arrangement of parts which have been herein described and illustrated in order to explain the nature of this invention and its operation may be made of those of skill in the art within the principal and scope of the invention as expressed in the following claims.

it will be understood further that the "Abstract of the Disclosure" set forth above is intended to provide a non-legal technical statement of the contents of the disclosure in compliance with the Rules of Practice of the United States Patent and Trademark Office and is not intended to limit the scope of the invention described and claimed herein.

What is claimed is:

1. In the apparatus for forming a reinforced concrete pipe in a vertical position comprising a removable inner form, a removable outer form and a support for the lower end of said pipe, a sealing assembly for the lower end portion of each of said forms comprising a depending seal plate assembly attached to and extending along one surface of the lower end portion of each of said forms in a continuous manner, said one form surface being opposite the surface of each form which will be in contact with a forming pipe, a flexible and continuous sealing member attached to each seal plate assembly and forming a chamber between said seal plate assembly and said flexible sealing member and means to cause said flexible member to be extended into contact with each said support upon which the pipe is to be formed and to be withdrawn from such contact with said support.

2. The apparatus according to claim 1, wherein each seal plate assembly comprises a seal plate, an upper surface portion of which is secured to one surface of a spacer plate in a depending manner, which spacer plate is secured by its other surface to said one surface of the corresponding form in a depending manner to space said seal plate from said one surface, each flexible sealing member being secured at its uppermost end portion to a portion of said other surface of said spacer plate and at its lower end portion to the lower end portion of said seal plate to form said chamber.

3. The apparatus according to claim 1, wherein the means to cause extension and withdrawal of each flexible sealing member comprises at least one conduit for the admission of positive and negative pressure to said chamber.

4. The apparatus according to claim 2, wherein each flexible sealing member is secured to said spacer plate and to the upper portion of said seal plate by a plurality of bolt and locking nut devices passing through a first continuous metal band in contact with said uppermost end portion of said sealing member at a plurality of points spaced around said flexible member, and secured to the lower portion of said seal plate by a second plurality of bolt and locking nut devices passing through a second continuous metal band in contact with said lower end portion of said sealing member, each of said bands having a L-shape with an inwardly turned lip on the longer leg, the shorter leg providing a seat for the respective edge of the flexible member, the flexible member being gripped by each lip when the bolt and locking nut devices are inserted and tightened.

5. The apparatus according to claim 2, wherein the flexible sealing member is secured to said spacer plate and to said seal plate by a bonding selected from the group of chemical and thermal bondings.

6. The apparatus according to claim 2, wherein a camming plate is secured to the lower edge of each seal plate, said camming plate serving to initially position said support when each form is placed in position for the pipe forming operation, the camming surface of said plate sloping downwardly and away from said support.

7. The apparatus according to claim 1, further comprising a flat annular ring secured to each said one surface of each of said forms and to each seal plate assembly by means of welds.

8. The apparatus according to claim 1, wherein each sealing assembly is secured by welding to the underside of a first flat annular ring and said first flat annular ring is bolted to a second flat annular ring which is welded to the lower end portion of each of said forms, said first and second annular rings extending radially away from the one surface of each of said forms.

* * * * *